US006520550B2

(12) United States Patent
Kunst et al.

(10) Patent No.: US 6,520,550 B2
(45) Date of Patent: Feb. 18, 2003

(54) MOTOR VEHICLE LOCK WITH ANTI-THEFT FEATURE

(75) Inventors: Frank Kunst, Olfen (DE); Checrallah Kachouh, Dortmund (DE); Norbert Frohne-Brinkmann, Heiligenhaus (DE)

(73) Assignee: Brose Schliesssysteme GmbH, Coburg (DE)

( * ) Notice: Subject to any disclaimer, the term of this patent is extended or adjusted under 35 U.S.C. 154(b) by 0 days.

(21) Appl. No.: 09/835,111

(22) Filed: Apr. 16, 2001

(65) Prior Publication Data

US 2002/0011733 A1 Jan. 31, 2002

(30) Foreign Application Priority Data

Apr. 14, 2000 (DE) ..... 100 18 889

(51) Int. Cl.[7] ..... E05C 3/06
(52) U.S. Cl. ..... 292/216; 292/DIG. 23
(58) Field of Search ..... 292/216, 201, 292/DIG. 23; 70/264

(56) References Cited

U.S. PATENT DOCUMENTS 4,978,154 A * 12/1990 Kleefeldt ..... 292/201
5,802,894 A * 9/1998 Jahrsetz ..... 70/264
5,868,444 A * 2/1999 Brackmann ..... 292/201
5,893,593 A * 4/1999 Dowling ..... 292/336.3
5,921,595 A * 7/1999 Brackmann ..... 292/216
5,984,384 A * 11/1999 Hamaguchi ..... 292/216

FOREIGN PATENT DOCUMENTS

| | | |
|---|---|---|
| DE | 39 02 873 A1 | 12/1990 |
| DE | 295 21 918 U1 | 9/1998 |
| EP | 0 637 665 B1 | 2/1995 |

* cited by examiner

*Primary Examiner*—Gary Estremsky
(74) *Attorney, Agent, or Firm*—Nixon Peabody LLP; David S. Safran

(57) ABSTRACT

A motor vehicle lock with lock elements, such as a rotary latch (2) and a detent pawl (3), and with a lock mechanism for controlled actuation of the detent pawl (3). The lock mechanism has a detent pawl lever (5), an inside actuation lever (7), a coupling lever (9) which couples the inside actuation lever (7) to the detent pawl lever (5) or decouples from it, and a central interlock lever (11). The central interlock lever (11), on the one hand, can be moved by a central interlock drive into the released position and the locked position, and on the other hand, can be mechanically moved out of the locked position into the release position by actuating the inside actuation lever. The coupling lever (9) can be moved via the anti-theft lever (12) into the coupling position and the decoupling anti-theft position. The pivot axis (8) of the coupling lever (9) is arranged on the inside actuation lever (7), at a distance from the pivot axis (8) of the inside actuation lever (7), and is not mounted on the lock housing. The pivot axis (4) of the inside actuation lever (7) is preferably identical to the pivot axis (4) of the detent pawl lever (5).

11 Claims, 7 Drawing Sheets

MOTOR VEHICLE LOCK WITH ANTI-THEFT FEATURE

BACKGROUND OF THE INVENTION

1. Field of the Invention

This invention relates to a motor vehicle lock, especially a side door lock, but also a rear door lock or a hatch lock, with lock elements, such as a rotary latch and a detent pawl and with a lock mechanism for controlled actuation of the detent pawl, the lock mechanism having a detent pawl lever which is supported on a housing-mounted pivot axis, an inside actuation lever which can be actuated from the inside door handle and which is supported on a housing-mounted pivot axis acting in the same direction, a coupling lever which couples the inside actuation lever to the detent pawl lever or decouples from it and which is supported on a pivot axis which acts in the same direction, and a central interlock lever which is supported preferably on a housing-mounted pivot axis acting in the same direction, which couples the outside door handle to the detent pawl lever or the detent pawl or decouples from it. The central interlock lever, on the one hand, can be moved by a motorized central interlock drive into the release position which couples the outside door handle to the detent pawl lever and the detent pawl and a locked position which decouples the outside door handle, and on the other hand, can be mechanically moved out of the locked position into the release position by actuating the inside actuation lever, and the coupling lever can be moved by a mechanical locking element and/or by a motorized anti-theft drive, especially via an anti-theft lever (12), into the coupling position and the decoupling anti-theft position and in the anti-theft position the inside actuation lever (7) executing preferably one idle stroke.

2. Description of Related Art

The known motor vehicle lock underlying the present invention (published European Application EP 0 637 665 B1/German Application DE 694 00 217 T2) is structurally comparatively simple because it has an inside actuation lever in the lock mechanism supported on the same stationary pivot axis with a coupling lever and a central interlock lever. In addition, the detent pawl lever which transmits the triggering motion to the detent pawl is supported on the housing-mounted pivot axis which acts in the same direction. Depending on the position of an anti-theft lever which is driven from the anti-theft drive, the inside actuation lever is active or inactive relative to the detent pawl. Incidentally, a child safety function is set up which can be activated or deactivated by an electric drive.

In the construction known from the prior art, it is feasible that, both in the "anti-theft" position and also in the "child-safe" position, the inside actuation lever executes an idle stroke, and therefore, need not be deflected relative to the blocked lever of the lock mechanism against spring force. The lock mechanism is not exposed to increased forces by this free wheeling construction.

Based on the fact that all the levers are supported on pivot axes which act in the same direction on the housing, the prerequisites for low-force activation of the motor vehicle lock are good. Based on the use of the pivot axis of the inside actuation lever for supporting a host of other levers, the space requirement laterally is also relatively small. For this reason, the known motor vehicle lock is relatively tall in the axial direction of the pivot axes. Therefore, it cannot be installed everywhere.

Finally, the actuating forces for the detent pawl lever are relatively high due to the lateral offset of the pivot axis with respect to the pivot axis of the inside actuation lever in spite of being located in one plane.

SUMMARY OF THE INVENTION

A primary object of the present invention is to devise a construction for a motor vehicle lock with a lock mechanism which extends in essentially one plane, therefore with the pivot axes of the different levers of the lock mechanism which act in the same direction, that is optimized with respect to its operation and actuation.

The aforementioned object in a motor vehicle lock is achieved of the initially mentioned type by the pivot axis of the coupling lever being arranged on the inside actuation lever, free of the housing at a distance from the pivot axis of the inside actuation lever. Because the pivot axis of the coupling lever is arranged on the inside actuation lever differently than in the prior art, i.e., is not attached to the housing, but is at a distance from the pivot axis of the inside actuation lever, the coupling lever can be angularly displaced to different degrees both with respect to the detent pawl lever and also with respect to the central interlock lever. Therefore, the action which occurs can be different when the coupling lever is displaced, on the one hand, for the detent pawl lever, and on the other, for the central interlock lever. This yields another degree of freedom for the actuation of the motor vehicle lock.

In the following, the invention is explained in detail using two embodiments which are described with reference to the attached drawings.

DETAILED DESCRIPTION OF THE INVENTION

Figure 1:
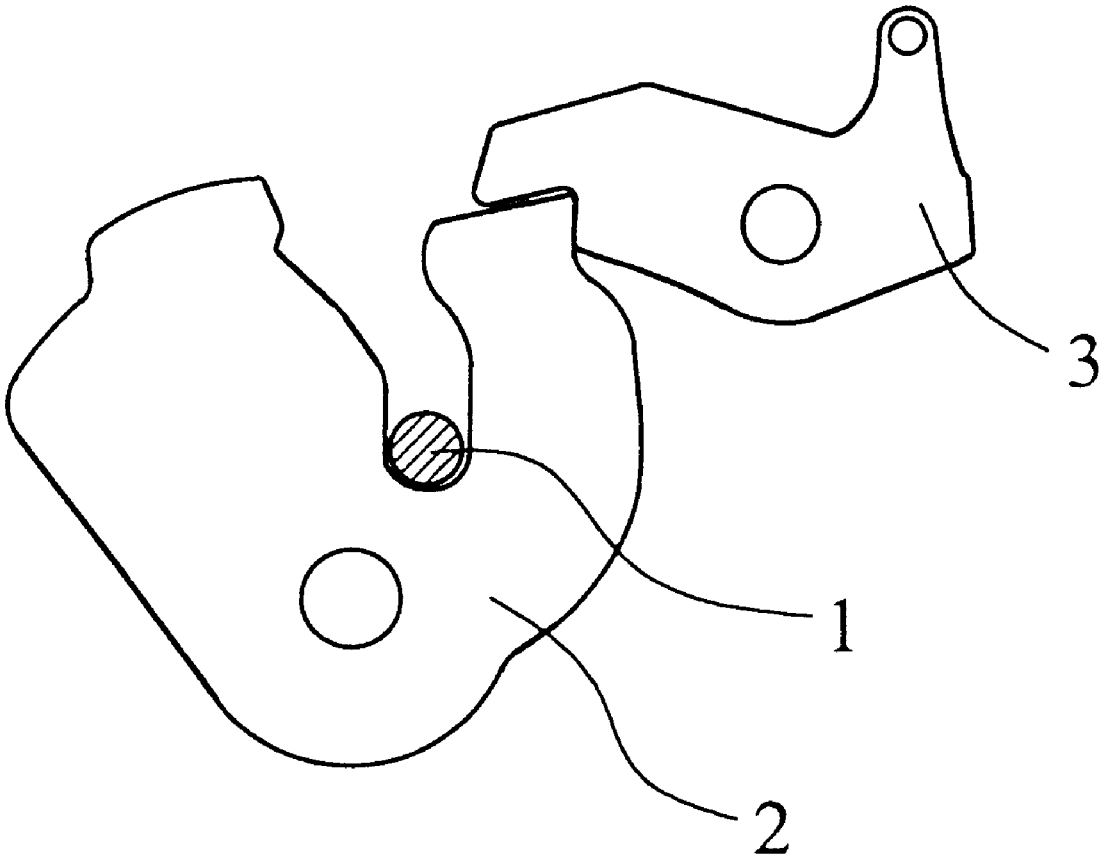
FIG. 1 shows the lock elements of a motor vehicle lock in accordance with the invention.

FIG. 1 shows, first of all, the basic principle of a motor vehicle lock as is used especially as a side door lock, but also as a rear door lock or hatch lock in motor vehicle bodies. FIG. 1 shows the active lock elements of the motor vehicle lock, here, a rotary latch 2 which engages a locking bracket or locking journal 1, and a detent pawl 3 which keeps the rotary latch 2 in the preliminary catch position and the main catch position, as is comprehensively known from the prior art (See, German patent publications DE 694 00 217 T2, DE 39 02 873 A1, and DE 295 21 918 U1, to name only a few examples).

The motor vehicle lock of the type under consideration, of course, includes a lock mechanism which has a detent pawl lever 5 supported on a housing-mounted pivot axis 4. The detent pawl 3 or the driving journal of the detent pawl 3 or another transmission lever to the detent pawl 3 engages the lower, actuating end 6 of the detent pawl lever 5 (pawl 3 being diagrammatically represented in phantom in FIG. 2 without being shown in FIGS. 3 to 12).

An inside actuation lever 7, which is actuated from the inside door handle, is supported on a housing-mounted pivot axis 4 extending in the same direction; in this preferred embodiment, inside actuation lever 7 is on the same pivot axis 4 as the detent pawl lever 5, but such not necessarily so. A coupling lever 9, which couples the inside actuation lever 7 to the detent pawl lever 5, or decouples from it, is supported on another pivot axis 8 which extends in the same direction as axis 4.

In the preferred embodiment shown, there is another housing-mounted pivot axis 10 extending in the same direction, on which a central interlock lever 11 is supported which couples the outside door handle to the detent pawl lever 5 or the detent pawl 3 or decouples from it. Basically, the central interlock lever 11, as also implemented in other prior art, can be pushed or swung, and need not be supported on the housing-mounted pivot axis 10. This embodiment shows this as an especially preferred embodiment.

The central interlock lever 11 can first be moved by a motorized central interlock drive, which is not further shown here, into a release position which couples the outside door handle and a locked position which decouples the outside door handle. This is typical of a central interlock lever 11. To this extent therefore in any case there is a motorized central interlock drive which is also the case in the prior art underlying the invention. But moreover the central interlock lever 11 can also be mechanically moved into the release position from the locked position by actuating the inside actuation lever 7. This means that when the inside actuation lever 7 is pulled with the central interlock lever 11 in the locked position, the safety device is automatically ejected, the motor vehicle lock can be opened from the inside, whether in the same stroke, or in a second following stroke (double stroke function). Both are known from the prior art.

The coupling lever 9 which is active towards the inside actuation lever 7 for its part can be moved by a mechanical locking element which is generally a locking cylinder or the like which is accessible from the outside and/or by a motorized anti-theft drive into a coupling position and a decoupling anti-theft position. To do this, in the preferred embodiment shown an anti-theft lever 12 is used. In the anti-theft position, the inside actuation lever 7, in this embodiment and according to one preferred teaching, executes an idle stroke. In this way, the actuating force on the inside actuation lever 7 is determined solely by the weak reset spring and the lock mechanism is not especially strongly loaded.

The prior art discloses approaches in which the inside actuation lever 7 is blocked in the anti-theft position or must be deflected against the spring force of a coupling spring (German Utility Model DE 295 21 918 U1).

Furthermore, the lock mechanism of this embodiment has, without this being shown in particular, at the corresponding matching locations, conventional reset springs, at two stable positions, also tilt springs.

The illustrated motor vehicle lock as in accordance with the invention is characterized, first of all, by the pivot axis 8 of the coupling lever 9 being located on the inside actuation lever 7 not mounted on the housing, but at a distance from the pivot axis 8 of the inside actuation lever 7. The coupling lever 9 pivots around the pivot axis 8 on the inside actuation lever 7 so that the bearing point of the coupling lever 9 is displaced jointly with the pivot of the inside actuation lever 7 around the pivot axis 4. This yields another degree of freedom because, specifically, the pivot motion of the inside actuation lever 7 and the pivot motion of the coupling lever 9 can be superimposed on one another.

According to one preferred construction, which is also implemented in the embodiment, it is provided that the pivot axis of the inside actuation lever 7 is identical to the pivot axis 4 of the detent pawl lever 5. This was already addressed at the beginning for the illustrated embodiment. Because, on the one hand, the coupling lever 9 is pivotally mounted on the inside actuation lever 7, and on the other hand, the detent pawl lever 5 and the inside actuation lever 7 are located on the same pivot axis 4, all levers lie in identically aligned planes and there is no relative motion between the inside actuation lever 7 and the detent pawl lever 5 with the coupling lever 9 engaged. This yields low friction loss, and the actuating forces on the inside actuation lever 7 are low.

The embodiment shown also illustrates that the pivot axis 10 of the central interlock lever 11 is located mounted on the housing at a distance from the pivot axis 4 of the inside actuation lever 7. This means that the central interlock lever 11 is, first of all, pivotally arranged, and furthermore, means that with the parallel plane, there is a lateral offset. This creates the possibility here for displacement of the different levers relative to one another in order to implement the desired control functions of the lock mechanism.

This embodiment furthermore shows that the pivot axis 10 of the central interlock lever 11, at the same time, forms the drive shaft of the central interlock drive. This is provided only in the preferred embodiment, and is not essential.

Furthermore, the preferred embodiment shown indicates that the anti-theft lever 12 is driven from a motorized anti-theft drive and that, in the embodiment shown, the pivot axis 13 of the anti-theft lever 12, which likewise extends in the same direction, is located mounted on the housing, and at the same time, forms the drive shaft of the anti-theft drive. This is not essential, but has advantages in terms of arrangement.

This embodiment shows also that the inside actuation lever 7 has a driver 14 which acts on a side of the detent pawl lever 5 in the return direction. This driver 14 ensures that the inside actuation lever 7 in the actuation direction (shown by the arrow on the right in FIG. 2) can also move independently of the detent pawl lever 5, while in the reverse direction of motion of the inside actuation lever 7 and the detent pawl lever 5 which follows beforehand, the return motion of the detent pawl lever 5 arises by form-fit under the action of the inside actuation lever 7.

Additionally, the preferred embodiment shown indicates that the detent pawl lever 5 has an actuating lug 15 for the central interlock lever 11. This ensures that the actuating lug 15 of the detent pawl lever 5 which adjoins the central interlock lever 11 which is in the locked position in FIG. 2 begins, immediately with the start of the pivot motion of the detent pawl lever 5, to overthrow the central interlock lever 11 into the release position.

In many of the constructions known in the prior art, for a lock mechanism which works with one stroke on the first part of the path of the inside actuation lever 7, the central interlock lever 11 is thrown over, and only then is the detent pawl lever 5 actuated on the remaining part of the path. The embodiment shown, on the other hand, uses the complete stroke path of the inside actuation lever 7 for the detent pawl lever 5. This reduces the actuating forces because a longer actuating path is available for the lifting of the detent pawl 3.

In order to absolutely ensure the overthrow of the central interlock lever 11 which takes place essentially at the same time with the motion of the detent pawl lever 5 under the above explained circumstances, the preferred embodiment shown illustrates that the central interlock lever 11 forms or has a recess 16 into which the actuating lug 15 of the detent pawl lever 5 can plunge in an overstroke.

Figure 2:
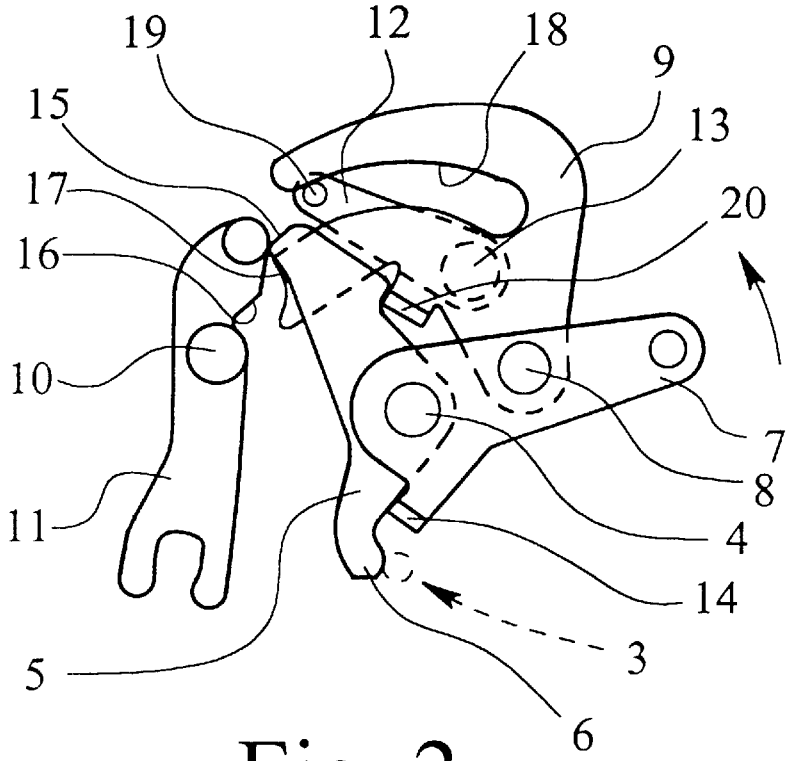
FIG. 2 shows a first embodiment of the lock mechanism of a motor vehicle lock in accordance with the invention, the lock mechanism operating with one stroke, here in the "locked, not child-safe" position, with the inside actuation lever not actuated.
Figure 3:
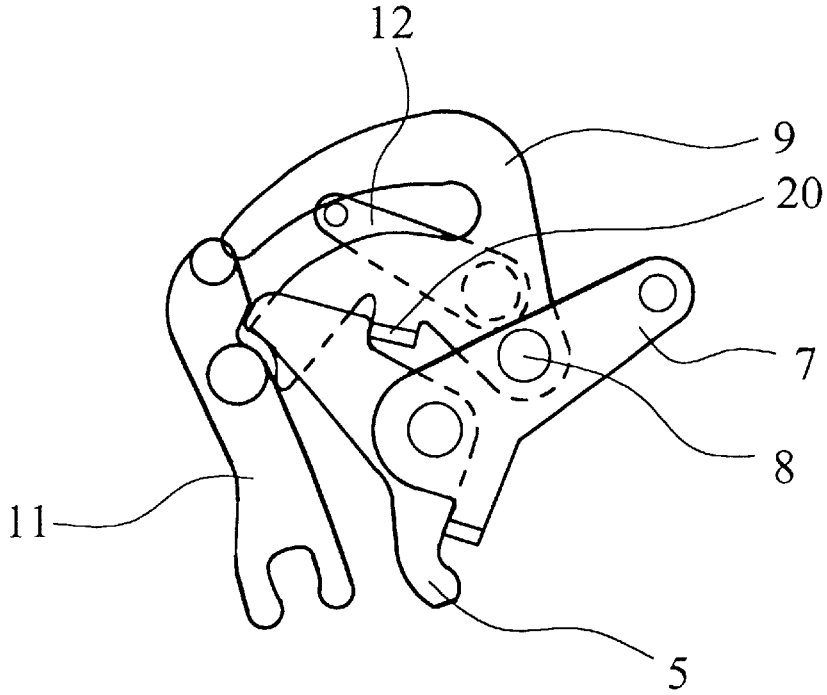
FIG. 3 shows the lock mechanism of FIG. 2, released with the inside actuation lever actuated.

FIG. 3 shows how the central interlock lever 11 which has been thrown over from FIG. 2 to FIG. 3 has now reached the release position. The inside actuation lever 7 with the detent pawl lever 5 can however continue a short distance farther because the actuating lug 15 of the detent pawl lever 5 can plunge into the recess 16 on the central interlock lever 11. The overstroke implemented in this way ensures that the central interlock lever 11 has necessarily been shifted into the release position.

Furthermore, the preferred embodiment shown indicates that the coupling lever 9 has an actuating lug 17 for the central interlock lever 11. It has been explained above that the special arrangement of the coupling lever 9 on the inside actuation lever 7 decouples its motion from that of the inside actuation lever 7 in another degree of freedom. This is used to a special degree here by the actuating lug 17 on the coupling lever 9 being used automatically for control, therefore for overthrow, of the central interlock lever 11. In other words, the central interlock lever 11 can also be thrown over from the locked position into the released position only by the coupling lever 9 without the actuating lug 15 on the detent pawl lever 5 touching the central interlock lever 11.

Figure 4:
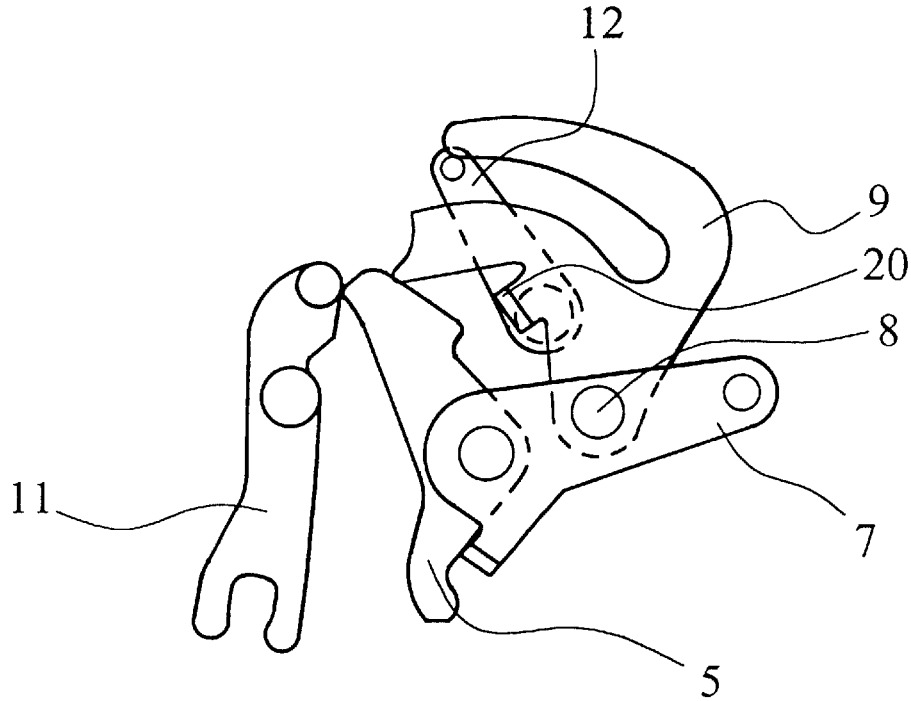
FIG. 4 is a representation corresponding to FIG. 2, but in child-safe position.
Figure 5:
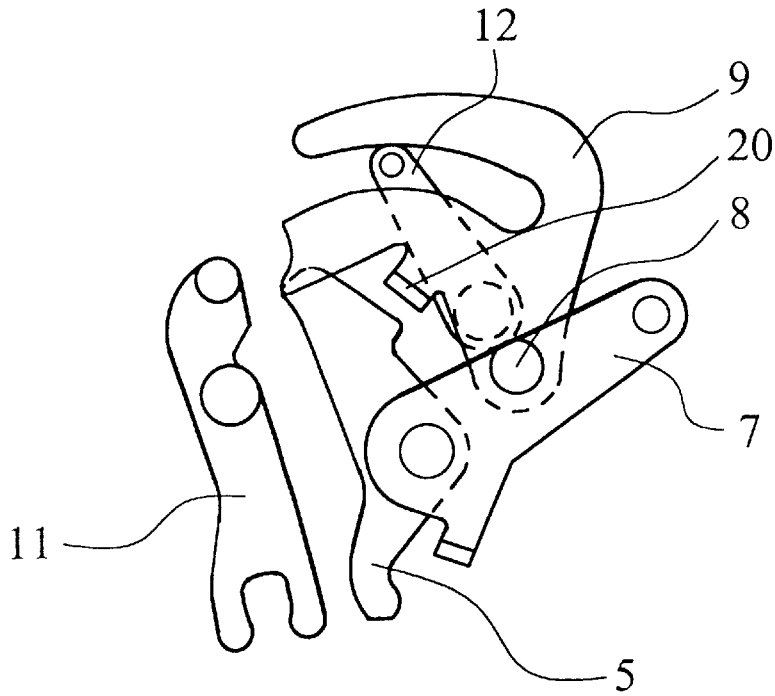
FIG. 5 shows the child-safe position of FIG. 4, but with the inside actuation lever actuated and the central interlock lever shifted into the released position.

In FIG. 4 in the transition to FIG. 5 the above explained function is apparent. It is used for child safety of the motor vehicle of the invention. Here, it can be stated that the child pulls the inside actuation lever 7 and thus moves the coupling lever 9, but does not move the detent pawl lever 5 from FIG. 4 to FIG. 5 in this position. The central interlock lever 11 is thrown over by the action of the coupling lever 9 into the unlocked position; pulling on the outside door handle can cause opening of the door. Nevertheless the child cannot open the door by actuating the inside actuation lever 7.

The above described control of the coupling lever 9 takes place in the embodiment shown in that the coupling lever 9 has a crank 18 which is formed, as referenced to motion, of an arc-shape into which the anti-theft lever 12 with the control element 19, which in this embodiment is a control journal, fits. This can be viewed in FIGS. 1 to 6 without difficulties.

Figure 6:
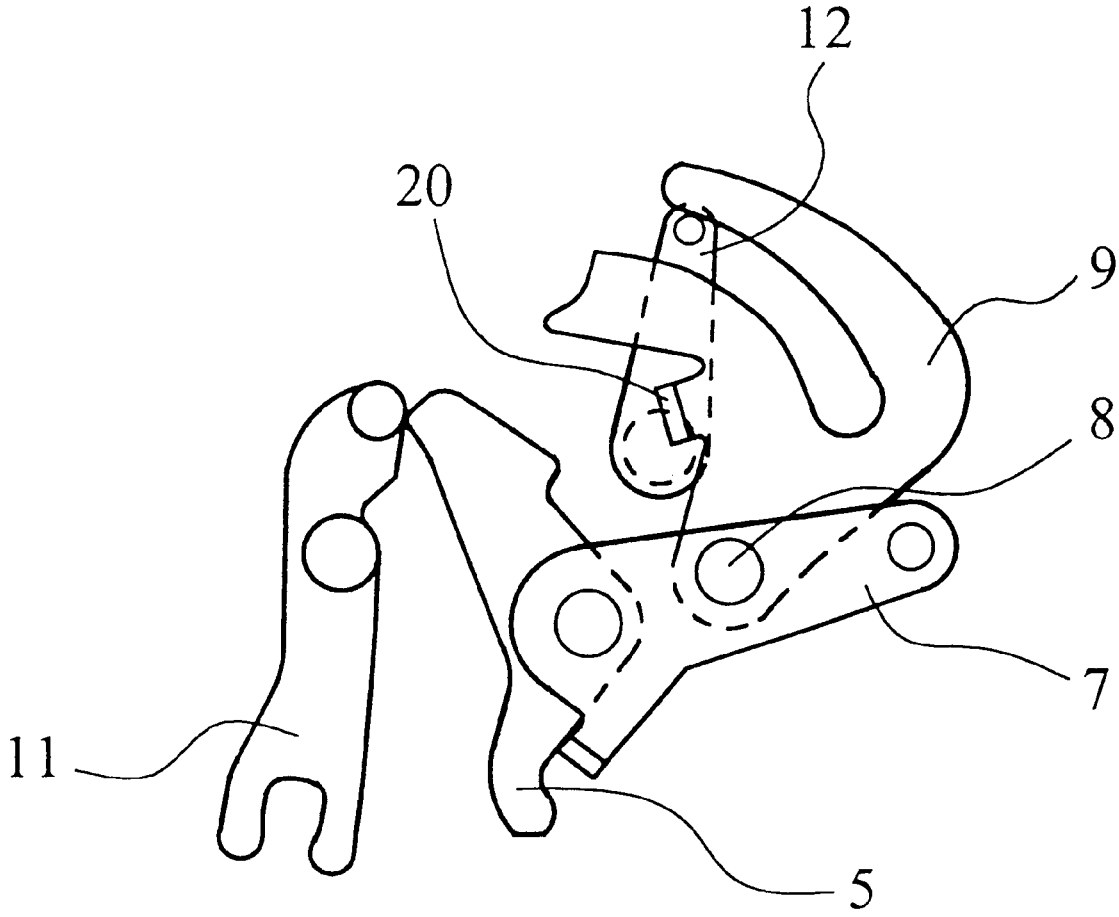
FIG. 6 is a representation corresponding to FIGS. 2 & 4 but with the lock mechanism in the "anti-theft "position"
Figure 7:
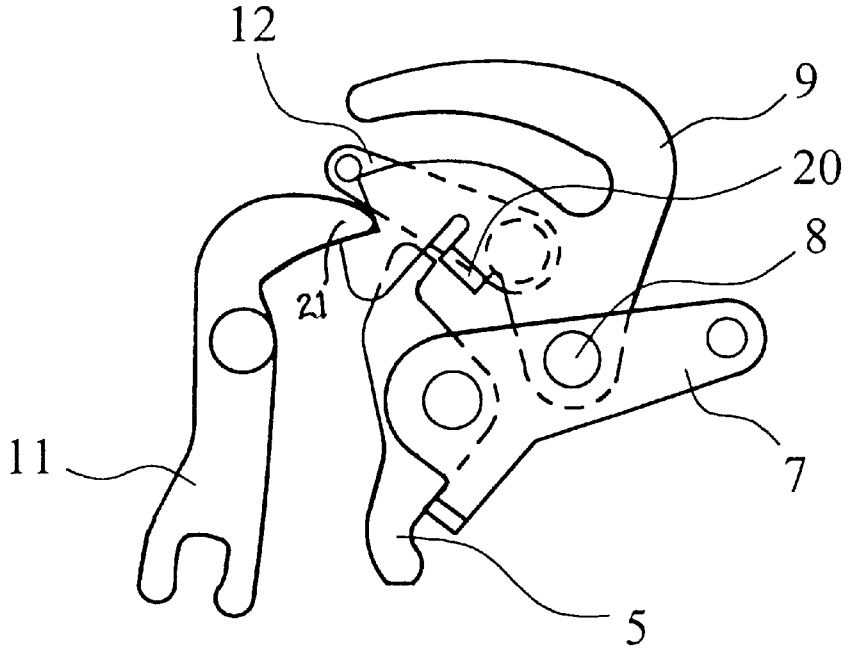
FIG. 7 shows a lock mechanism operating with two strokes, according to a second embodiment of the invention, in a locked, not child-safe position, with the inside actuation lever not actuated.
Figure 8:
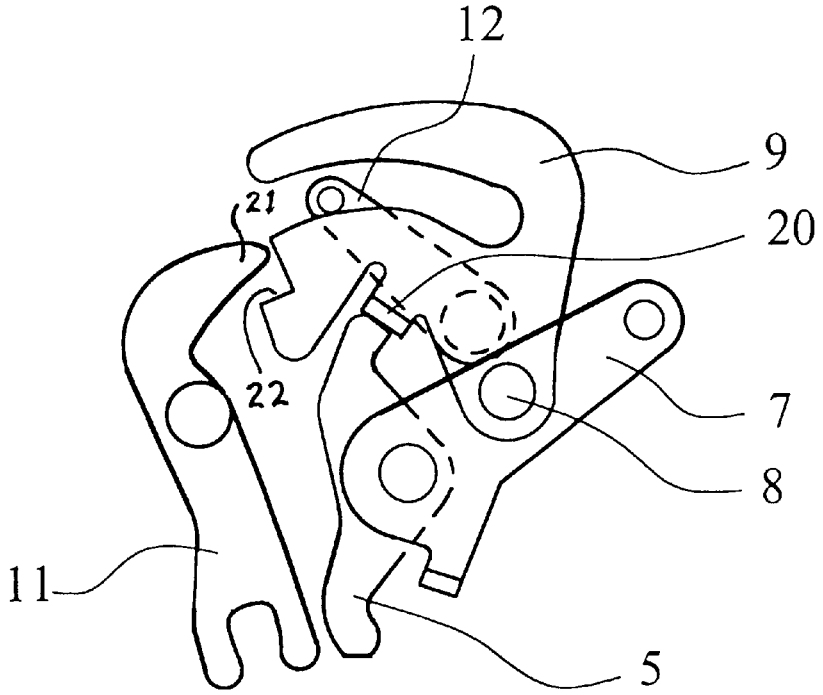
FIG. 8 shows the embodiment from FIG. 7 with the inside actuation lever actuated in the first stroke.

FIG. 6 finally shows the anti-theft position of the motor vehicle lock. The anti-theft lever 12 is swung with the control element 19 far to the right and thus, in this way, has swung the coupling lever 9 clockwise via the crank 18 far around the pivot axis 8 on the inside actuation lever 7. The coupling lever 9 is swung out both with the driver 20 to the detent pawl lever 5 and also with the actuating lug 17 so far that opening actuation of the inside actuation lever 7, therefore pivoting by the stipulated angle counterclockwise around the pivot axis 4, has no effect on the central interlock lever 11 and the detent pawl lever 5. Therefore, even if the inside door handle is pulled, the motor vehicle door, in this case, will not open. This corresponds to the desired anti-theft effect, i.e., no opening possibility from the outside and from the inside.

For the case of the anti-theft feature explained last, there is of course the possibility of resetting the anti-theft lever 12, for example, by a lock cylinder by means of a key from the outside, therefore for emergency release. Otherwise the anti-theft lever 12, in the embodiment shown, is set back by means of the motorized anti-theft drive, if the central interlock system is switched into the released position by remote control.

The other embodiment shown in FIGS. to 7 to 12 corresponds largely constructively to the embodiment of FIGS. 1 to 6, so that a description of corresponding features for purposes of repetition are superfluous. The same reference numbers designate the same elements.

The second embodiment of FIGS. 7 to 12 however differs from the first embodiment in that the lock mechanism of this motor vehicle lock works with two strokes. Thus, the so-called "double stroke function" is implemented. In the lock mechanism which is located in the locked position, initial pulling on the inside actuation lever 7 leads to release and only repeated pulling on the inside actuation lever 7 after prior complete return into the initial position then leads to opening, therefore to lifting of the detent pawl 3.

Figure 9:
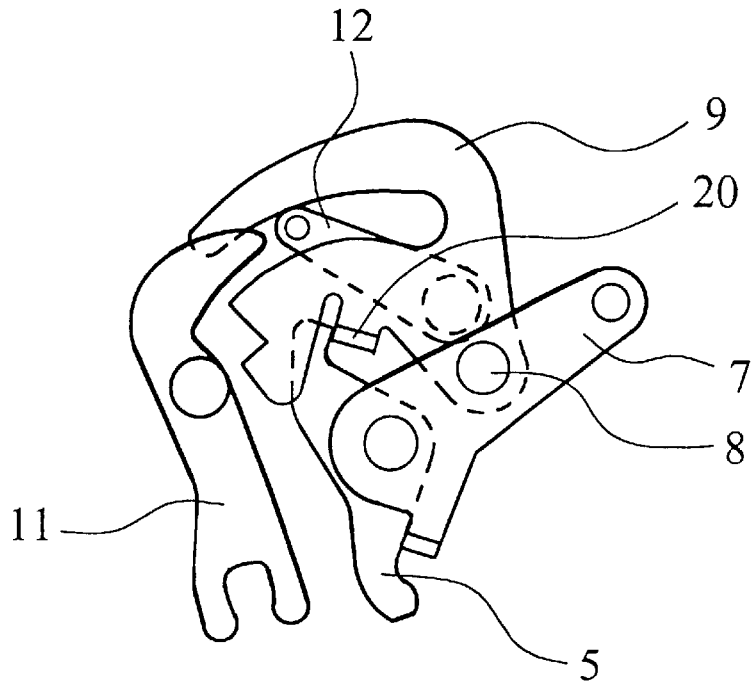
FIG. 9 shows the FIG. 7 embodiment with the inside actuation lever in the second stroke to lift the detent pawl.

In this embodiment, so that this two-stroke actuation is possible, it is necessary for the coupling lever 9, in the locked position of the central interlock lever 11, to be kept pivoted out such that its driver 20 cannot interact with the detent pawl lever 5. The preferred embodiment shown solves this problem by the central interlock lever 11 having a shaped piece 21 which prevents the coupling lever 9 from engaging the coupling position when the central interlock lever 11 is in the locked position. This position is well illustrated in FIG. 7 in the transition to FIG. 8. The shaped piece 21 rests on a notch 22 of the coupling lever 9 and prevents the coupling lever 9 from being pivoted so far to the left that the driver 20 couples to the detent pawl lever 5. FIG. 9 then shows the situation after repeated pulling on the inside actuation lever 7 after prior return. Since the central interlock lever 11 in the first stroke from FIG. 7 to FIG. 8 has been pivoted into the released position, the shaped piece 21 is no longer in the way of the anti-theft lever 12, the crank lever 9 can engage the detent pawl lever 5 with the driver 20 and can lift the detent pawl 3.

Figure 10:
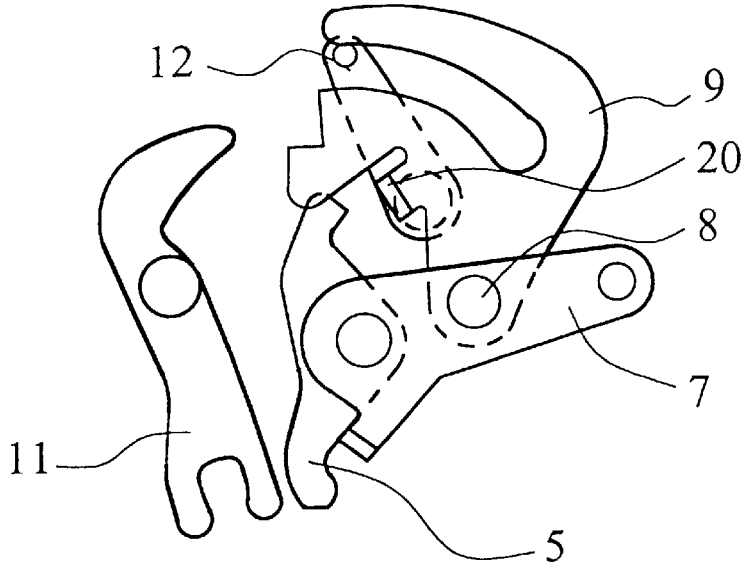
FIG. 10 is a representation corresponding to FIG. 7, but in the child-safe position.
Figure 11:
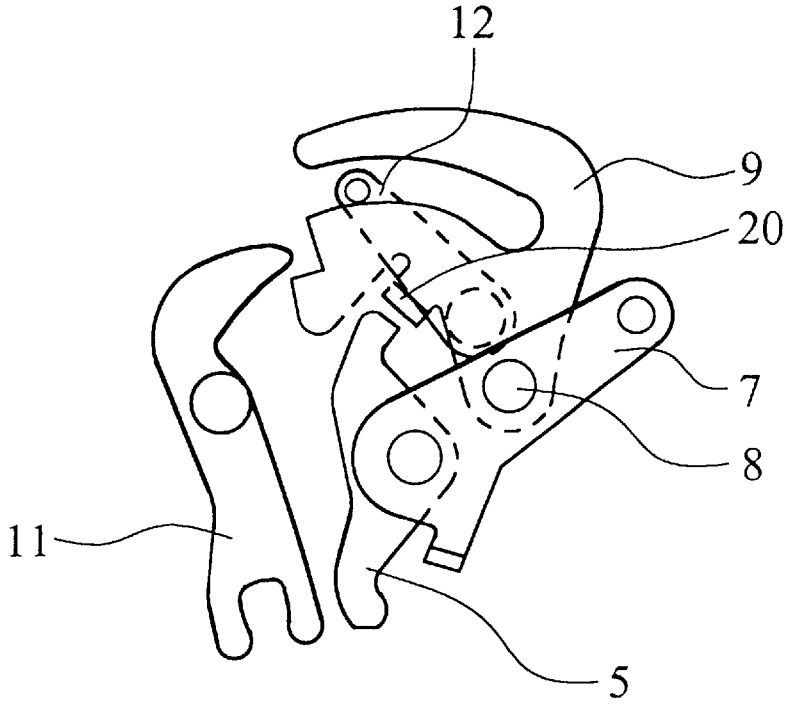
FIG. 11 is a representation showing the child-safe position of FIG. 7, but with the inside actuation lever actuated.
Figure 12:
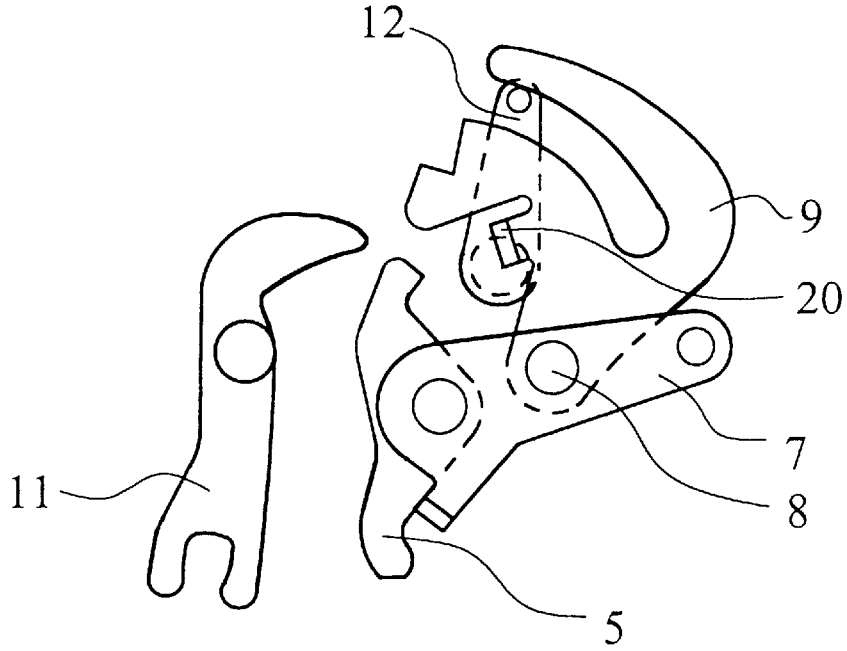
FIG. 12 is a representation showing the child-safe position of FIG. 7, but with the anti-theft feature engaged.

FIGS. 4 & 5, on the one hand, and FIGS. 10 & 11, on the other hand, show for both embodiments a preceding special child safety function. This was already addressed above. The two constructions are made such that the coupling lever 9 in addition to the decoupling anti-theft position has a decoupling child safety position which precedes the anti-theft position in the direction of the coupling position and into which it can be moved by means of the anti-theft drive and/or by means of a child safety element or child safety drive, and in which the central interlock lever 11 can be moved out of the locked position mechanically into the released position by actuating the inside actuation lever 7. In the second embodiment, therefore, in the position with the child safety engaged, the coupling lever 9 does reach the central interlock lever 11 for purposes of overthrow into the released position, but at the same time, remains free with its driver 20 from the detent pawl lever 5 in any case, since the anti-theft lever 12 keeps the coupling lever 9 raised correspondingly far enough by means of the crank 18.

FIG. 12 finally shows again for the second embodiment the anti-theft position in which no actuation of the motor vehicle lock at all is possible.

What is claimed is:

1. Motor vehicle lock comprising:

a lock housing, lock elements including a rotary latch and a detent pawl, and a lock mechanism for controlled actuation of the detent pawl, the lock mechanism having a detent pawl lever which is supported on a housing-mounted pivot axis, an inside actuation lever which is actuatable from an inside door handle and which is supported on a housing-mounted pivot axis that extends in the same direction as the pivot axis of the detent pawl lever, a coupling lever which couples and decouples the inside actuation lever with the detent pawl lever and which is supported on a pivot axis which extends in the same direction as the pivot axes of the detent pawl lever and inside actuation lever, the coupling lever being movable into a coupling position and a decoupling anti-theft position, and a central interlock lever which is adapted to couple and decouple an outside door handle with one of the detent pawl lever and the detent pawl, the central interlock lever being movable into a released position for coupling the outside door handle to the detent pawl lever and the detent pawl and into a locked position for decoupling the outside door handle, and also being mechanically movable out of the locked position into the released position by actuation of the inside actuation lever;

wherein the pivot axis of the coupling lever is arranged on the inside actuation lever, free of the housing at a distance from the pivot axis of the inside actuation lever and wherein the pivot axis of the inside actuation lever is identical to the pivot axis of the detent pawl lever.

2. Motor vehicle lock comprising:

a lock housing, lock elements including a rotary latch and a detent pawl, and a lock mechanism for controlled actuation of the detent pawl, the lock mechanism having a detent pawl lever which is supported on a housing-mounted pivot axis, an inside actuation lever which is actuatable from an inside door handle and which is supported on a housing-mounted pivot axis that extends in the same direction as the pivot axis of the detent pawl lever, a coupling lever which couples and decouples the inside actuation lever with the detent pawl lever and which is supported on a pivot axis which extends in the same direction as the pivot axes of the detent pawl lever and inside actuation lever, the coupling lever being movable into a coupling position and a decoupling anti-theft position, and a central interlock lever which is adapted to couple and decouple an outside door handle with one of the detent pawl lever and the detent pawl, the central interlock lever being movable into a released position for coupling the outside door handle to the detent pawl lever and the detent pawl and into a locked position for decoupling the outside door handle, and also being mechanically movable out of the locked position into the released position by actuation of the inside actuation lever;

wherein the pivot axis of the coupling lever is arranged on the inside actuation lever, free of the housing at a distance from the pivot axis of the inside actuation lever and wherein the pivot axis of the central interlock lever is mounted on the housing at a distance from the pivot axis of the inside actuation lever.

3. Motor vehicle lock as claimed in claim 2, further comprising a central interlock drive coupled to the central interlock lever wherein the pivot axis of the central interlock lever at the same time forms a drive shaft of the central interlock drive.

4. Motor vehicle lock comprising:

a lock housing, lock elements including a rotary latch and a detent pawl, and a lock mechanism for controlled actuation of the detent pawl, the lock mechanism having detent pawl lever which is supported on a housing-mounted pivot axis, an inside actuation lever which is actuatable from an inside door handle and which is supported on a housing-mounted pivot axis that extends in the same direction as the pivot axis of the detent pawl lever, a coupling lever which couples and decouples the inside actuation lever with the detent pawl lever and which is supported on a pivot axis which extends in the same direction as the pivot axes of the detent pawl lever and inside actuation lever, the coupling lever being movable into a coupling position and a decoupling anti-theft position, a central interlock lever which is adapted to couple and decouple an outside door handle with one of the detent pawl lever and the detent pawl, the central interlock lever being movable into a released position for coupling the outside door handle to the detent pawl lever and the detent pawl and into a locked position for decoupling the outside door handle, and also being mechanically movable out of the locked position into the released position by actuation of the inside actuation lever; and a pivotally mounted anti-theft lever having pivot axis which forms a drive shaft of an anti-theft drive, wherein the pivot axis of the coupling lever is arranged on the inside actuation lever, free of the housing at a distance from the pivot axis of the inside actuation lever.

5. Motor vehicle lock comprising:

a lock housing, lock elements including a rotary latch and a detent pawl, and a lock mechanism for controlled actuation of the detent pawl, the lock mechanism having a detent pawl lever which is supported on a housing-mounted pivot axis, an inside actuation lever which is actuatable from an inside door handle and which is supported on a housing-mounted pivot axis that extends in the same direction as the pivot axis of the detent pawl lever, a coupling lever which couples and decouples the inside actuation lever with the detent pawl lever and which is supported on a pivot axis which extends in the same direction as the pivot axes of the detent pawl lever and inside actuation lever, the coupling lever being movable into a coupling position and a decoupling anti-theft position, and a central interlock lever which is adapted to couple and decouple an outside door handle with one of the detent pawl lever and the detent pawl, the central interlock lever being movable into a released position for coupling the outside door handle to the detent pawl lever and the detent pawl and into a locked position for decoupling the outside door handle, and also being mechanically movable out of the locked position into the released position by actuation of the inside actuation lever;

wherein the pivot axis of the coupling lever is arranged on the inside actuation lever, free of the housing at a distance from the pivot axis of the inside actuation lever and wherein the inside actuation lever has a driver which acts on a a return direction side of the detent pawl lever.

6. Motor vehicle lock comprising:

a lock housing, lock elements including a rotary latch and a detent pawl, and a lock mechanism for controlled actuation of the detent pawl, the lock mechanism having a detent pawl lever which is supported on a housing-mounted pivot axis, an inside actuation lever which is actuatable from an inside door handle and which is supported on a housing-mounted pivot axis that extends in the same direction as the pivot axis of the detent pawl lever, a coupling lever which couples and decouples the inside actuation lever with the detent pawl lever and which is supported on a pivot axis which extends in the same direction as the pivot axes of the detent pawl lever and inside actuation lever, the coupling lever being movable into a coupling position and a decoupling anti-theft position, and a central interlock lever which is adapted to couple and decouple an outside door handle with one of the detent pawl lever and the detent pawl, the central interlock lever being movable into a released position for coupling the outside door handle to the detent pawl lever and the detent pawl and into a locked position for decoupling the outside door handle, and also being mechanically movable out of the locked position into the released position by actuation of the inside actuation lever;

wherein the pivot axis of the coupling lever is arranged on the inside actuation lever, free of the housing at a distance from the pivot axis of the inside actuation lever and wherein the detent pawl lever has an actuating lug for the central interlock lever.

7. Motor vehicle lock as claimed in claim 6, wherein the actuating lug of the detent pawl lever, in the released position of the central interlock lever, adjoins the central interlock lever with at most a small gap, and wherein the central interlock lever has a recess into which the actuating lug of the detent pawl lever can plunge in an overstroke.

8. Motor vehicle lock comprising:

a lock housing, lock elements including a rotary latch and a detent pawl, and a lock mechanism for controlled actuation of the detent pawl, the lock mechanism having a detent pawl lever which is supported on a housing-mounted pivot axis, an inside actuation lever which is actuatable from an inside door handle and which is supported on a housing-mounted pivot axis that extends in the same direction as the pivot axis of the detent pawl lever, a coupling lever which couples and decouples the inside actuation lever with the detent pawl lever and which is supported on a pivot axis which extends in the same direction as the pivot axes of the detent pawl lever and inside actuation lever, the coupling lever being movable into a coupling position and a decoupling anti-theft position, and a central interlock lever which is adapted to couple and decouple an outside door handle with one of the detent pawl lever and the detent pawl, the central interlock lever being movable into a released position for coupling the outside door handle to the detent pawl lever and the detent pawl and into a locked position for decoupling the outside door handle, and also being mechanically movable out of the locked position into the released position by actuation of the inside actuation lever;

wherein the pivot axis of the coupling lever is arranged on the inside actuation lever, free of the housing at a distance from the pivot axis of the inside actuation lever and wherein the coupling lever has an actuating lug for the central interlock lever.

9. Motor vehicle lock as claimed in claim 4, wherein the coupling lever has an arc-shaped slot into which a control element of the anti-theft lever fits to control the coupling lever.

10. Motor vehicle lock comprising:

a lock housing, lock elements including a rotary latch and a detent pawl, and a lock mechanism for controlled actuation of the detent pawl, the lock mechanism having a detent pawl lever which is supported on a housing-mounted pivot axis, an inside actuation lever which is actuatable from an inside door handle and which is supported on a housing-mounted pivot axis that extends in the same direction as the pivot axis of the detent pawl lever, a coupling lever which couples and decouples the inside actuation lever with the detent pawl lever and which is supported on a pivot axis which extends in the same direction as the pivot axes of the detent pawl lever and inside actuation lever, the coupling lever being movable into a coupling position and a decoupling anti-theft position, and a central interlock lever which is adapted to couple and decouple an outside door handle with one of the detent pawl lever and the detent pawl, the central interlock lever being movable into a released position for coupling the outside door handle to the detent pawl lever and the detent pawl and into a locked position for decoupling the outside door handle, and also being mechanically movable out of the locked position into the released position by actuation of the inside actuation lever;

wherein the pivot axis of the coupling lever is arranged on the inside actuation lever, free of the housing at a distance from the pivot axis of the inside actuation lever and wherein the central interlock lever has a shaped piece which prevents the coupling lever from engaging the coupling position when the central interlock lever is in the locked position.

11. Motor vehicle lock comprising:

a lock housing, lock elements including a rotary latch and a detent pawl, and a lock mechanism for controlled actuation of the detent pawl, the lock mechanism having a detent pawl lever which is supported on a housing-mounted pivot axis, an inside actuation lever which is actuatable from an inside door handle and which is supported on a housing-mounted pivot axis that extends in the same direction as the pivot axis of the detent pawl lever, a coupling lever which couples and decouples the inside actuation lever with the detent pawl lever and which is supported on a pivot axis which extends in the same direction as the pivot axes of the detent pawl lever and inside actuation lever, the coupling lever being movable into a coupling position and a decoupling anti-theft position, and a central interlock lever which is adapted to couple and decouple an outside door handle with one of the detent pawl lever and the detent pawl, the central interlock lever being movable into a released position for coupling the outside door handle to the detent pawl lever and the detent pawl and into a locked position for decoupling the outside door handle, and also being mechanically movable out of the locked position into the released position by actuation of the inside actuation lever;

wherein the pivot axis of the coupling lever is arranged on the inside actuation lever, free of the housing at a distance from the pivot axis of the inside actuation lever and wherein the coupling lever, in addition to the decoupling anti-theft position, is movable into a decoupling child safety position which precedes the anti-theft position in a direction toward the coupling position, and in which the central interlock lever is mechanically movable out of the locked position into the released position by actuating the inside actuation lever.

* * * * *